US005979387A

United States Patent [19]

Strait et al.

[11] Patent Number: 5,979,387

[45] **Date of Patent: *Nov. 9, 1999**

[54] QUICK REPLACEMENT SPARK PLUG ASSEMBLY

[76] Inventors: William P. Strait, 103 Sea Stepps Ct., Jupiter, Fla. 33477; Gordon R Ripma, 140 Pine Hill Trail W., Tequesta, Fla. 33469

[ * ] Notice: This patent is subject to a terminal disclaimer.

[21] Appl. No.: 09/006,378

[22] Filed: Jan. 13, 1998

Related U.S. Application Data

[63] Continuation-in-part of application No. 08/749,334, Nov. 14, 1996, Pat. No. 5,706,847.

[51] Int. Cl.[6] ..... H01T 13/08

[52] U.S. Cl. ..... 123/169 PA; 123/169 R; 313/135

[58] Field of Search ..... 123/169 PA, 169 R, 123/169 PH, 169 CB; 313/135, 148

[56] References Cited

U.S. PATENT DOCUMENTS 5,186,132 2/1993 Runge ..... 123/169 R
5,283,499 2/1994 Adam et al. ..... 123/169 R
5,706,847 1/1998 Strait et al. ..... 123/169 PA
5,839,403 11/1998 Grant et al. ..... 123/169 R

*Primary Examiner*—Willis R. Wolfe
*Assistant Examiner*—Hieu T. Vo
*Attorney, Agent, or Firm*—Price, Heneveld, Cooper, DeWitt & Litton

[57] ABSTRACT

An arrangement for easily and rapidly replacing a spark plug in a bore of a cylinder head includes a conductive cylindrical body that screws into the bore. It has a tapered internal passage that receives a replaceable plug with a tapered metal outer surface. A resilient sealing ring retained by the plug seals gas tight against the inner passage. An annular groove on the outer surface of the plug receives groove engaging elements or balls mounted in the body to lock the plug securely in position. A sliding locking sleeve surrounds the groove engaging elements and prevents the elements from moving out of the groove in a locked position. The sleeve may be manually reciprocated to an unlocked position in which the elements are free to move out of the groove so that the plug may be easily replaced. A spring biases the sleeve to the locked position.

23 Claims, 3 Drawing Sheets

QUICK REPLACEMENT SPARK PLUG ASSEMBLY

This invention is a continuation in part of U.S. application Ser. No. 08/749,334, filed Nov. 14, 1996, now U.S. Pat. No. 5,706,847 issued Jan. 13, 1998.

FIELD OF THE INVENTION

The present invention relates to spark plugs for internal combustion engines and more particularly to spark plugs that may be more rapidly and easily replaced.

BACKGROUND OF THE INVENTION

Ordinary spark plugs have an external thread on a metal outer shell with a hexigonal head. They seat in a threaded bore of the cylinder head with a deformable gasket seal. Complete sealing and correct positioning of the spark in the combustion chamber requires a precise torque. Excessive torque or incorrect positioning may strip the threads in the cylinder head, requiring expense repairs. Space for tools such as torque wrench is limited in many engine compartments and access is often awkward. All of the problems associated with spark plug replacement are magnified in auto racing competition with engine heat and time constraints added.

U.S. Pat. No. 5,186,132 issued Feb. 16, 1993 to Runge teaches a plug-in spark plug that requires a special bore in the cylinder head with a retaining groove for engaging a locking circlip. It requires some sort of tool fitting in a groove to forcefully pull the plug out and a tool for engaging the circlip to reduce its diameter to disengage it from the retaining groove. It would be desirable to have a system that would operate with conventionally bored and threaded cylinder heads, since most consumers don't replace their own plugs and we could not expect the engine manufacturers to provide the special cylinder heads.

U.S. Pat. No. 3,747,583 issued Jul. 24, 1973 to Gerard Georges and Erich Spengler teaches a quick insertion spark plug arrangement in which an outer sleeve screws into the threaded bore in a cylinder head. The sleeve has an inner profile that cooperates with an outer profile of the plug.

In a first rotary position of the plug, it may be moved axially into and out of the sleeve. When the inserted plug is rotated about its axis a finite angle by a special tool, the inner and outer profiles cooperate to lock the position of the plug against axial movement in a threaded engagement.

Quick disconnect couplings for joining conduits for high pressure fluids are exemplified by U.S. Pat. Nos. 3,162,470 issued Dec. 22, 1964 to Davidson and SWAGELOK (Registered Trademark) full flow quick-connect coupling QF series made by the Swagelok Company of Hudson, Ohio. These use a hand-operated sliding locking sleeve that requires no tool for engagement and disengagement. This style of connection has not been applied to spark plugs.

SUMMARY OF THE INVENTION

It is accordingly an object of the invention to provide a spark plug assembly that enables a user to replace the plug quickly and surely without the use of special tools.

It is another object that the assembly be useable with the conventionally bored and tapped cylinder head.

It is yet another object that the assembly comprise an outer member that screws into the cylinder head and remains in place and an inner, replaceable plug member that carries the spark gap and resilient sealing ring for making a gas tight, high pressure seal with the outer member. The outer member includes a sliding outer sleeve and an inner locking body that is provided with an external thread for engaging the threaded bore in the cylinder head. A gasket makes a gas tight joint between the two. The locking body has may transverse apertures in which balls seat so that a portion of the ball protrudes into the inner cylindrical space of the locking body. The plug member is provided with a locking annular groove arranged to receive the protruding portions of the balls to lock the plug member against axial motion. The locking sleeve in a locking position engages the outer tangent of each ball and prevents it from moving out of the annular groove in the plug member. A spring maintains the sleeve in this locking position. The sleeve may be pushed axially against the spring bias to an unlocked position in which the balls are free to move out of the annular groove when the plug is pulled axially.

These and other objects, advantages and features of the invention will become more apparent from the detailed description taken with the drawings, and in which like reference numerals are applied to like elements in the various figures.

BRIEF DESCRIPTION OF THE DRAWINGS

FIG. 7 is an exploded front elevation view, partially broken away, of another embodiment of the invention.

FIG. 8 is an exploded front elevation view, partially broken away, of another embodiment of the invention.

DETAILED DESCRIPTION OF PREFERRED EMBODIMENTS

Figure 1:
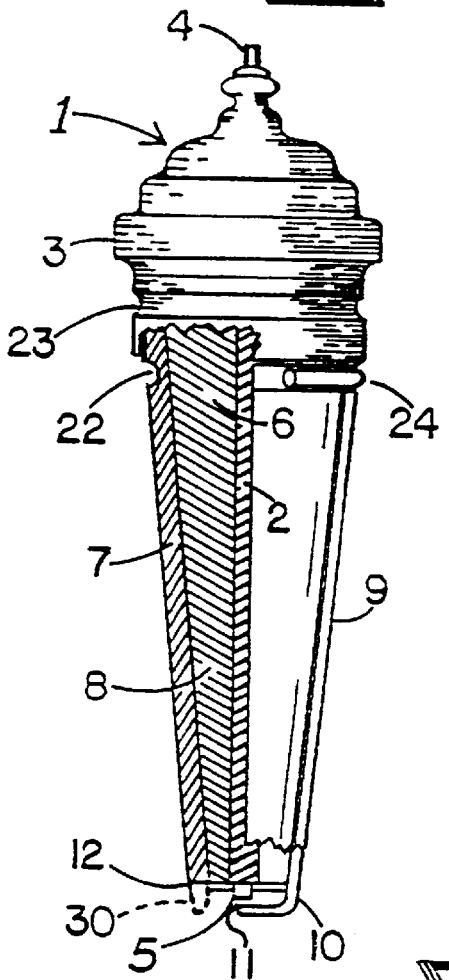
FIG. 1 is a front elevation view of a spark plug of the invention partially broken away.
Figure 4:
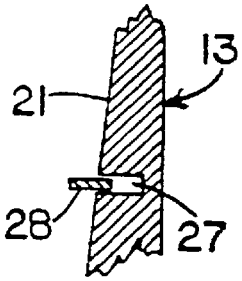
FIG. 4 is a sectional detail view of the electrically conductive spring ring retained in the body groove.
Figure 5:
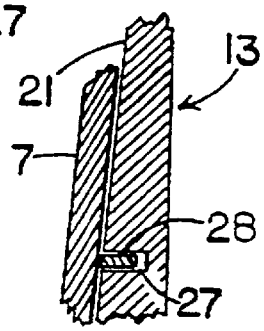
FIG. 5 is a sectional detail view as in FIG. 4 with the plug in place.

Referring now to the drawings, a spark plug 1 has a ceramic insulator element 6 that is electrically insulating, supporting and surrounding an axial electrode 2, with a top end 4 adapted for conventional connection to an electric source and a lower end 5 for insertion within the combustion chamber of an internal combustion engine. An electrically conductive member 7 encircles the lower portion 8 of the insulator element 6. It has a tapered cylindrical outer surface 9. The bottom end 12 of member 7 is attached to a metal bracket 10 to provide a spark gap 11 of conventional design. Alternatively, as shown in phantom, the lower end of member 7 extends down to the level of the end 5 of the electrode 2 to form the ring electrode 30.

An electrically and thermally conductive cylindrical body 13 has an inner portion 14 that cooperates with a bore 18 in a cylinder head 17, shown in phantom, to form a gas tight and electrically conductive seal. This may be achieved by cooperating internal threads 18 in the bore and external threads 16 on the body 13 in conjunction with a metal gasket 31 as is well known in the art. Alternatively, other means well known in the art such as brazing, welding, and the like may be used to secure the body in position in the cylinder head as desired.

The body 13 has an internal passage 19 with a taper 21 that is narrower at its inner end 20 that corresponds to the external tapered surface 9 of the plug so that the two extended surfaces will be in intimate contact for electrical and thermal conductivity therebetween when the plug is fully inserted in the body.

A circumferential annular first groove 22 in the outer surface 9 of the plug retains a heat-resistant sealing ring 24 which deforms and seals against the tapered surface 21 of the passage 19 in the body.

Figure 6:
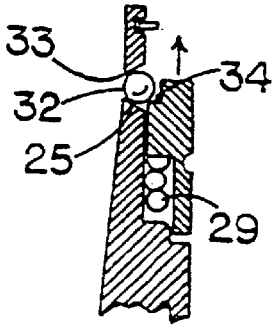
FIG. 6 is a sectional view as in FIG. 3 of the unlocked position.
Figure 2:
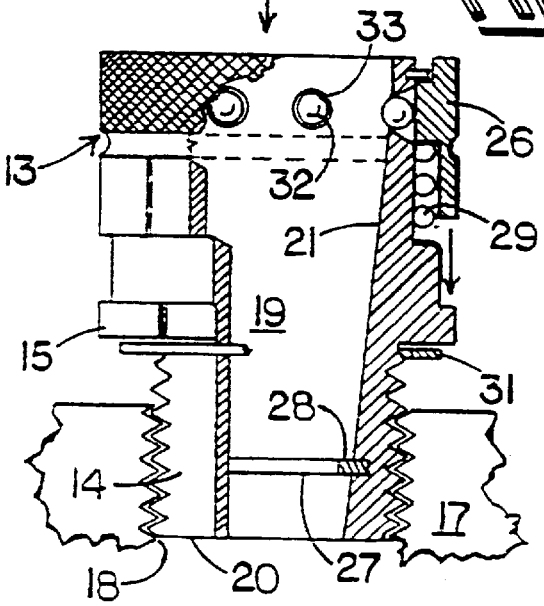
FIG. 2 is a front elevation view of a cylindrical locking body of the invention partially broken away.
Figure 3:
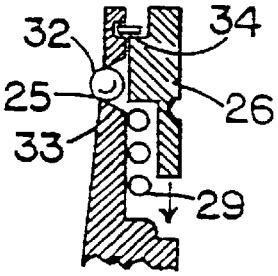
FIG. 3 is a sectional detail view of the sealing and locking mechanism in locked position.
Figure 1:
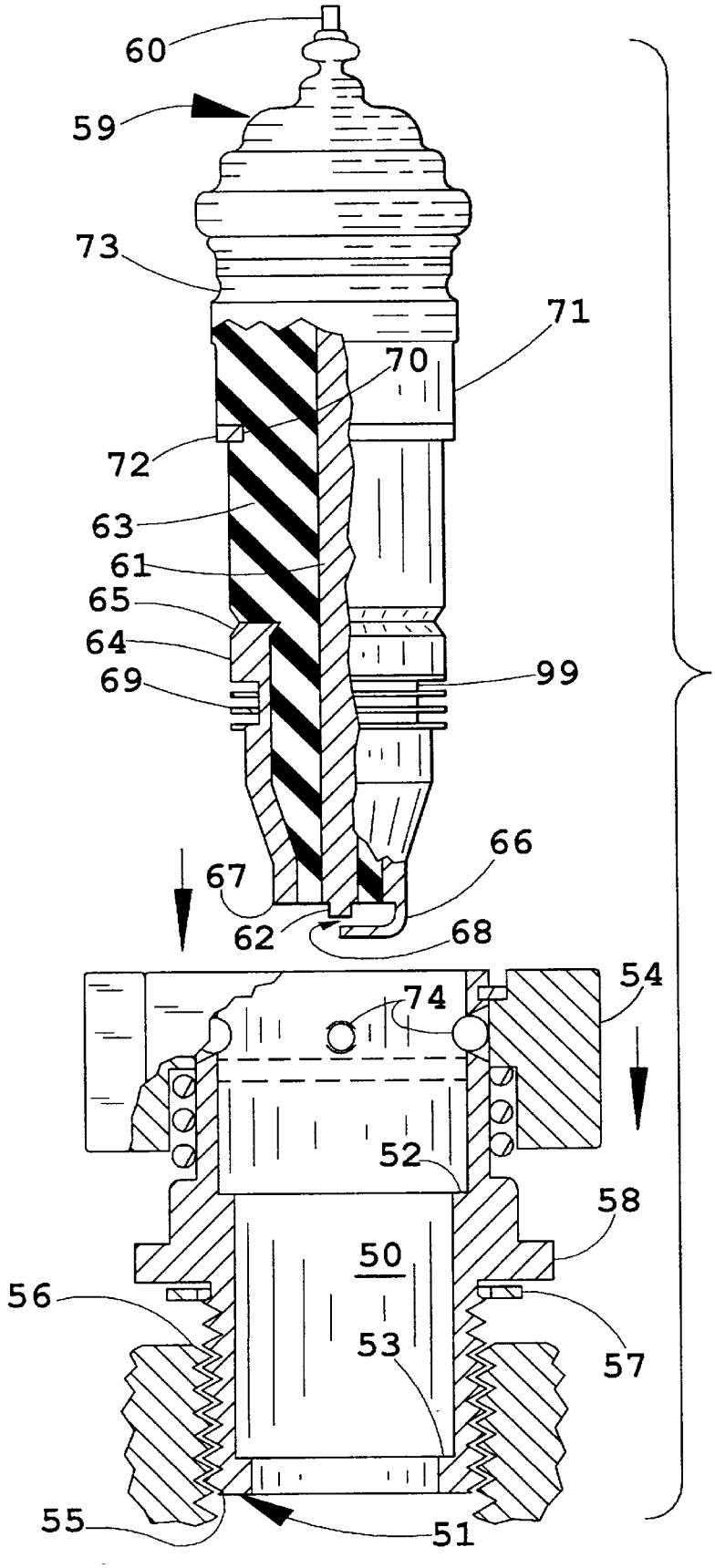
Figure 2:
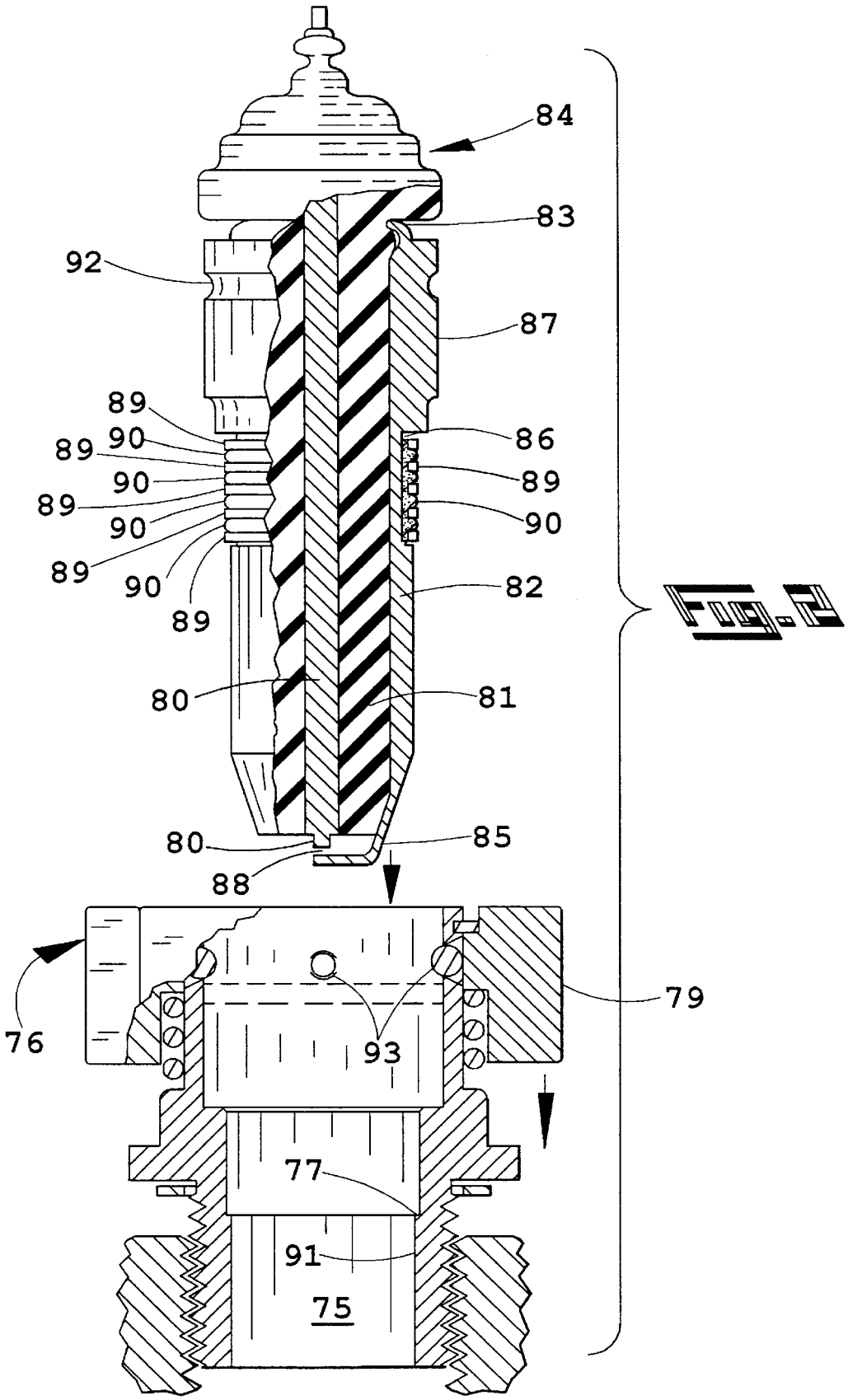

A circumferential annular second groove 23 in the outer surface of the plug locks the plug in its fully inserted position in body 13 in cooperation with groove engaging means 25 held securely in the outer portion 15 of body 13. The groove engaging means shown comprises a plurality of hard steel balls held in a series of uniformly spaced apart recesses 32 in the outer portion 15 which are open to the outer circumference of the body portion. An aperture 33 on the inner aspect of the recess allows a portion of the ball to protrude therethrough and into the second groove 23, to lock the plug securely in place at a precise position. The balls move freely in and out of the recess in an unlocked operating condition, as illustrated in FIG. 6. A locking sleeve 26 reciprocates between the unlocked position of FIG. 6 and the locked position of FIGS. 3 and 2. In the locked position, a step 34 on the interior aspect of the sleeve holds the balls at their locking position extending into the locking groove 23 in the plug. A compression spring 29 applies spring bias between the sleeve and the body forcing the sleeve to the locked condition.

To remove and replace the plug, the sleeve is simply manually pushed down and plug can be lifted out and replaced without special tools or skills. When the new plug is fully inserted, releasing the sleeve locks the plug securely in place against the combustion forces while the sealing ring 24 provides gas pressure sealing.

To further ensure electrical contact between the cylinder head and the conductive member 7, an annular groove 27 may optionally be provided in the inside surface of passage 19 to receive and retain a metal split spring ring 28 of the type well known in the art. This ring 28, in its relaxed state has a relaxed inside diameter that is less than the outside diameter of plug member 7 against which it will impinge when the plug is fully inserted in the body so that the ring will springably engage member 7. The outside diameter of ring 28 is large enough so that it will be retained in the groove when the plug is removed.

Referring now to FIG. 7 an embodiment of the invention is shown in which the internal passage 50 through the electrically and thermally conductive cylindrical body 51 does not have a taper. It has an internal upper shoulder 52 and an internal lower shoulder 53. The quick release mechanism 54 is as described above. An external thread 55 cooperates with the internal threaded bore 56 of a cylinder head, with gasket 57 making a gas tight seal. A hexagonal portion 58 is provided for wrench tightening. The easily replaceable spark plug portion 59 has an axial electrode 61 with a top end 60 for connection to an electric source, and a lower end 62 for engagement within the combustion chamber. An electrically insulating element 63 encircles the electrode 61. An electrically conductive member 64 encircles the insulator 63 at the lower end thereof and is secured by swaging at its upper end 65. A peripheral electrode 66 is attached to the lower end 67 of member 64 to form spark gap 68 between the two electrodes. A flat wire helical metal spring 69 is held captive on member 64 at recess 99 and extends radically sufficiently to be engaged by lower shoulder 53 in bore 50 of the cylindrical body 51 to thereby make electrical contact between the cylinder head and the peripheral electrode when the plug 59 is inserted into body 51. A first groove 70 in the outer surface 71 of the plug 59 holds a resilient, high-temperature-resistant sealing ring 72 of the type well know in the art such as the graphitic ring seals. When the plug is seated in body 51, the sealing ring 72 is compressed against the second shoulder 52 in the body 51 to form a pressure tight seal between the insulator 63 and the body 51. A second groove 73 in outer surface 71 receives the balls 74 of the quick release locking mechanism 54 as described above to maintain the plug locked in place and sealed against leakage of combustion gas.

Referring now to FIG. 8, another embodiment of the invention that does not rely on a tapered sealing joint is shown. An electrically and thermally conductive cylindrical body 76 for screwing into a cylinder head, as described above, has an internal passage 75 with an internal shoulder 77, and quick release mechanism 79. The easily replaceable spark plug portion 84 has an axial electrode 80. An electrically insulating element 81, such as ceramic, encircles electrode 80. An electrically conductive member 82 encircles the insulator 81 and is swaged on to it at upper end 83. A peripheral electrode 85 is welded to member 82 to form a spark gap 88 with electrode 80. A first groove means 86 is provided on the outer surface 87 of the plug for holding captive therein a helical, flat wire metal spring 89 that is wound on. This spring is so dimensioned that its lower end will engage shoulder 77 and be compressed as the plug is seated in body 76. This makes electrical contact between the electrode 85 and the cylinder head. Interposed between the coils of the spring is a cord 90 of resilient, temperature-resistant sealing material such as a graphite based composition well known in the art. As the spring compresses, the sealant is squeezed between the coils and extends radially to form a pressure seal against the interior wall 91 of body 76. An upper groove 92 in the outer surface 87 is adapted to receive the locking balls 93 of the quick release mechanism 79 as previously described.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. In an internal combustion engine including a cylinder head with at least one threaded bore for receiving an ignition device projecting into a combustion chamber, an arrangement for quick replacement of the ignition device, the arrangement comprising:

a) an electrically and thermally conductive cylindrical body having an inner portion, an outer portion and an external thread on the inner portion that cooperates with a threaded bore in a cylinder head for forming a gas tight seal between the body and the head, the body having an internal passage therethrough;

b) a spark plug having an outer surface, an axial electrode with a top end for connection to an electric source and a lower end for engagement with a combustion chamber, an electrically insulating insulator element encircling the axial electrode, and an electrically conductive member encircling the insulator element at the lower portion thereof and having a cylindrical outer surface corresponding to the internal passage of the body for engagement therewith; a peripheral electrode attached to the member at the bottom end thereof for cooperation with the axial electrode to provide a spark gap;

c) a circumferential first groove means in the outer surface of the spark plug, the first groove means for retaining an annular sealing means for engaging and sealing gas-tight against the internal passage of the body;

d) a circumferentially second groove in the outer surface of the spark plug above the first groove means;

e) groove engaging means for moving into the second groove to prevent axial movement of the spark plug when seated in the body, the groove engaging means being mounted on the body at the outer portion and arranged to move in and out of the second groove in a first mode of operation for ease of replacement of the spark plug and to be prevented from moving out of the second groove in a second mode of operation for maintaining the spark gap in a fixed position during combustion; and f) a locking sleeve encircling the body at the upper portion and reciprocating between a locked position in which the sleeve locks the groove engaging means in the second groove for the second mode of operation and an unlocked position for the first mode of operation.

2. The arrangement according to claim 1, further comprising bias means between the locking sleeve and the body for urging the locking sleeve to the second mode of operation.

3. The arrangement according to claim 2 wherein the groove engaging means are a plurality of balls.

4. The arrangement according to claim 3, further comprising an annular groove in the internal passage and an electrically conductive spring ring retained in the annular groove, the spring ring having a relaxed inside dimension that is less than the cylindrical surface of the conductive member against which it impinges when the plug is seated in the body.

5. The arrangement according to claim 1, further comprising an annular groove in the internal passage and an electrically conductive spring ring retained in the annular groove, the spring ring having a relaxed inside dimension that is less than the cylindrical surface of the conductive member against which it impinges when the plug is seated in the body.

6. The arrangement according to claim 1, in which the annular sealing means comprises a helical flat wire metal spring with a cord of resilient, heat-resistant sealing material interposed between coils of the spring.

7. In an internal combustion engine including a cylinder head with at least one bore for receiving an ignition device projecting into a combustion chamber, an arrangement for quick replacement of the ignition device, the arrangement comprising:

a) an electrically and thermally conductive cylindrical body having an inner portion, an outer portion and an external surface on the inner portion that cooperates with a bore in a cylinder head for forming a gas tight seal between the body and the head, the body having an internal passage therethrough;

b) a spark plug having an outer surface, an axial electrode with a top end for connection to an electric source and a lower end for engagement with a combustion chamber, an electrically insulating insulator element encircling the axial electrode, and an electrically conductive member encircling the insulator element at the lower portion thereof and having a cylindrical outer surface corresponding to the internal passage of the body for intimate engagement therewith; a peripheral electrode attached to the member at the bottom end thereof for cooperation with the axial electrode to provide a spark gap;

c) a circumferential first groove in the outer surface of the spark plug, the first groove retaining an annular sealing ring for engaging and sealing gas-tight against the internal passage of the body;

d) a circumferential second groove in the outer surface of the spark plug above the first groove;

e) groove engaging means for moving into the second groove to prevent axial movement of the spark plug when seated in the body, the groove engaging means being mounted on the body at the outer portion and arranged to move in and out of the second groove in a first mode of operation for ease of replacement of the spark plug and to be prevented from moving out of the second groove in a second mode of operation for maintaining the spark gap in a fixed position during combustion; and f) a locking sleeve encircling the body at the upper portion and reciprocating between a locked position in which the sleeve locks the groove engaging means in the second groove for the second mode of operation and an unlocked position for the first mode of operation.

8. The arrangement according to claim 7, further comprising bias means between the locking sleeve and the body for urging the locking sleeve to the second mode of operation.

9. The arrangement according to claim 6, wherein the groove engaging means are a plurality of balls.

10. The arrangement according to claim 7, further comprising an annular groove in the internal passage and an electrically conductive spring ring retained in the annular groove, the spring ring having a relaxed inside dimension that is less than the cylindrical surface of the conductive member against which it impinges when the plug is seated in the body.

11. A quick replacement spark plug assembly for an internal combustion engine having a cylinder head with at least one bore for receiving a spark plug for projection into a combustion chamber comprising:

a) an electrically and thermally conductive body having an inner portion, an outer portion and an external surface on the inner portion that is adapted to cooperate with a bore in a cylinder head for forming a gas-tight seal between the body and the head, the body having an internal passage extending therethrough in communication with the combustion member;

b) a spark plug having an outer surface, an axial electrode with a top end for connection to an electric source and a lower end for engagement with the combustion chamber, an electrically conductive member having at least a portion thereof intimately engaging the internal passage of the body and electrically insulated from the axial electrode, and a second electrode attached to the electrically conductive member and extending toward the lower end of said axial electrode for cooperation with the axial electrode to provide a spark gap;

c) an annular sealing element between said outer surface of said spark plug and the internal passage of the body for providing a gas-tight seal between the outer surface of said spark plug and the internal passage of the body;

d) a circumferential groove in the outer surface of the spark plug;

e) a groove engaging mechanism for moving into the groove to prevent axial movement of the spark plug when seated in the body, the groove engaging mechanism arranged to move in and out of the groove in a first mode of operation for ease of replacement of the spark plug and to be prevented from moving out of the groove in a second mode of operation for maintaining the spark gap in a fixed position during combustion; and f) a locking sleeve reciprocating between a locked position in which the sleeve locks the groove engaging mechanism in the groove for the second mode of operation and an unlocked position for the first mode of operation.

12. In an internal combustion engine including a cylinder head for mounting an ignition device including a spark plug into a combustion chamber, an arrangement for quick replacement of the spark plug, the arrangement comprising:

a) said cylinder head having an electrically and thermally conductive body extending upwardly therefrom;

b) a spark plug having an outer surface, an axial electrode with a top end for connection to an electric source and a lower end for engagement with the combustion chamber, an electrically conductive member having at least a portion thereof intimately engaging the internal passage of the body and electrically insulated from the axial electrode, and a second electrode attached to the electrically conductive member and extending toward the lower end of said axial electrode for cooperation with the axial electrode to provide a spark gap;

c) an annular sealing element between said outer surface of said spark plug and the internal passage of the body for providing a seal between the outer surface of said spark plug and the internal passage of the body;

d) a circumferential groove in the outer surface of the spark plug;

e) a groove engaging mechanism for moving into the groove to prevent axial movement of the spark plug when seated in the body, the groove engaging mechanism arranged to move in and out of the groove in a first mode of operation for ease of replacement of the spark plug and to be prevented from moving out of the groove in a second mode of operation for maintaining the spark gap in a fixed position during combustion; and f) a locking sleeve reciprocating between a locked position in which the sleeve locks the groove engaging mechanism in the second groove for the second mode of operation and an unlocked position for the first mode of operation.

13. A quick connect ignition device for a combustion engine having a cylinder head comprising:

an elongated spark plug having an outer surface, a first electrode extending lengthwise through said spark plug and having a top end for connection to an electrical source and a lower end for extending into a combustion chamber of a combustion engine;

a body having an internal passage therethrough for receiving said spark plug and having a first electrically conductive portion thereof for electrical connection to said cylinder head;

said outer surface of said spark plug having a second electrically conductive portion spaced outwardly of said first electrode for contacting the first electrically conductive portion of the body for intimate electrical connection therewith when said spark plug is located in said internal passage, said second electrically conductive portion being insulated from said first electrode;

a second electrode electrically connected to said second electrically conductive portion and extending toward the lower end of said first electrode and spaced from said lower end of said first electrode to provide a spark gap;

a locking mechanism having a first part thereof located on the outer side of the spark plug and a second part mounted in the internal passageway on said body said first and second parts cooperating with each other for locking said spark plug in fixed position within said internal passage and for releasing said spark plug from said fixed position for removal of said spark plug from said internal passage;

said locking mechanism including a locking member on said body, said locking member reciprocally movable relative to both said body and spark plug between a locked position in which the locking member is moved for locking said first and second parts together for maintaining the spark plug in a fixed position during combustion and an unlocked position in which the locking member releases said first and second parts of said locking mechanism permitting said spark plug to be easily removed from said internal passageway for replacement.

14. A quick connect ignition device of claim 13 in which said locking mechanism comprises:

a) said first part including a circumferential groove in the outer surface of the spark plug;

b) said second part including a groove engaging mechanism for moving into the groove to prevent axial movement of the spark plug when seated in the body, the groove engaging mechanism arranged to move in and out of the groove in a first mode of operation for ease of replacement of the spark plug and to be prevented from moving out of the groove in a second mode of operation for maintaining the spark gap in a fixed position during combustion; and c) said locking member includes a locking sleeve reciprocating between a locked position in which the sleeve locks the groove engaging mechanism in the groove for the second mode of operation and an unlocked position for the first mode of operation.

15. The quick connect ignition device of claim 14 in which the groove engaging mechanism includes a plurality of balls.

16. The quick connect ignition device of claim 14 in which a bias means is provided between the locking sleeve and body for urging the locking sleeve to the second mode of operation.

17. The quick connect ignition device of claim 13 in which said first electrically conductive portion includes the entire body constructed of electrically conductive material.

18. The quick connect ignition device of claim 17 in which the second electrically conductive portion is the entire outer surface of the spark plug.

19. The quick connect ignition device of claim 13 in which said locking member is a sleeve.

20. The quick connect ignition device of claim 19 in which the sleeve is mounted for reciprocation along the axis of said spark plug.

21. The quick connect ignition device of claim 20 in which a bias means is provided between the body and sleeve for urging the locking member to the locked position.

22. A spark plug quick release device comprising:

a spark plug having a cylindrical configuration and having a first conductor extending lengthwise through said spark plug from its top end to its bottom end, the spark plug further having a second sleeve conductor formed on the outer surface of the spark plug about a lower surface thereof, the second sleeve conductor further having an arm extending from a lower surface of the second sleeve conductor with a lower portion slightly spaced from the first conductor, the spark plug further having an annular detent formed therein in concentric relationship therewith;

a body with a hollow cylindrical configuration having an upper end and a lower end with a plurality of threaded grooves formed on the outer surface thereof for screwably coupling with a spark plug threaded mount;

a quick release assembly including a sliding sleeve slidably situated about an outer surface of the body, whereby the sliding sleeve has a lowered orientation and a raised orientation wherein ball bearings protrude from circular apertures of the body; and whereby upon the lowering of the quick release assembly and the insertion of the spark plug within the body, the quick release assembly may be released such that the ball bearings engage the annular detent of the spark plug.

23. A spark plug quick release system as set forth in claim 22, wherein springs are included such that the quick release assembly is biased in the lowered orientation to force the sliding tube upwardly to lock the spark plug in said body.

* * * * *

UNITED STATES PATENT AND TRADEMARK OFFICE

CERTIFICATE OF CORRECTION

PATENT NO. : 5,979,387
DATED : November 9, 1999
INVENTORS : William P. Strait et al.

It is certified that error appears in the above-identified patent and that said Letters Patent is hereby corrected as shown below:

Column 5, claim 1, line 12;
"circumferentially" should be --circumferential--.

Column 6, claim 9, line 36;
"claim 6" should be --claim 8--.

Column 6, claim 10, line 38;
"claim 7" should be --claim 9--.

Column 6, claim 11, line 55;
"member" should be --chamber--.

Signed and Sealed this

Twenty-seventh Day of June, 2000

*Attest:*

Q. TODD DICKINSON

*Attesting Officer*

*Director of Patents and Trademarks*